United States Patent [19]

Mahnke et al.

[11] 4,199,139

[45] Apr. 22, 1980

[54] EXERCISING APPARATUS

[75] Inventors: Parker E. Mahnke; Anthony J. DeMaeo, both of Glendale, Calif.

[73] Assignee: Marcy Gymnasium Equipment Co., Glendale, Calif.

[21] Appl. No.: 897,331

[22] Filed: Apr. 18, 1978

[51] Int. Cl.[2] ..... A63B 23/02

[52] U.S. Cl. ..... 272/118

[58] Field of Search ..... 272/117, 116, 118, 93, 272/134

[56] References Cited

U.S. PATENT DOCUMENTS

| | | | |
|---|---|---|---|
| Re. 28,066 | 7/1974 | Marcyan | 272/118 |
| 804,218 | 11/1905 | Fledler | 272/118 |
| 3,438,627 | 4/1969 | LaLanne | 272/118 |
| 3,647,209 | 3/1972 | Lanne | 272/118 |
| 3,850,431 | 11/1974 | Winans | 272/118 |
| 3,905,599 | 9/1975 | Mazman | 272/118 |
| 3,912,263 | 10/1975 | Yatso | 272/118 |
| 3,971,555 | 7/1976 | Mahnke | 272/118 |

FOREIGN PATENT DOCUMENTS

| | | | |
|---|---|---|---|
| 3430 | of 1906 | United Kingdom | 272/118 |

*Primary Examiner*—Richard J. Johnson

*Attorney, Agent, or Firm*—James E. Brunton

[57] ABSTRACT

An improved exercising apparatus specifically designed to permit, in a single compact unit, barbell type, lifting exercises as well as pull type, muscle toning exercises. Incrementally selectable, vertically movable weights are raised and lowered either by the exertion of vertical straight line forces on a vertically adjustable body engaging means removably connected to a vertically movable carriage which is directly coupled with the weights, or alternatively by the exertion of pull type forces on a second body engaging means coupled with the weights through a system of pulleys which reduces the amount of force required to raise the weights by a predetermined amount.

9 Claims, 4 Drawing Figures

EXERCISING APPARATUS

BACKGROUND OF THE INVENTION

1. Field of the Invention:

The present invention relates generally to physical conditioning devices. More particularly the invention relates to a unique highly compact exercising apparatus which may be used for a wide variety of muscle building as well as muscle toning exercises.

2. Discussion of the Prior Art:

The use of progressive resistance exercises for therapeutic and rehabilitative purposes has grown widely in popularity in recent years. Apparatus such as dumbbells, and barbells have traditionally been used for body building and for exercising the major muscle groups of the body. Similarily wall mounted units embodying vertically movable weights connected to cables reeved around pulleys have been used in gymnasiums for various types of muscle toning exercises.

Exercising devices and apparatus of the aforementioned character have, however, presented numerous difficulties. Serious safety problems, including handling hazards, weight balancing and muscle strains attend the use of dumbbells and barbells. The present invention overcomes these shortcomings by providing a compact, stable and completely safe apparatus in which the weights are safely supported within an upright structure and in which the trainee exerts vertical straight line forces on an adjustable body engaging means connected to a vertically movable carriage directly coupled with the weights. Prior art pulley type systems have generally proven extremely cumbersome and unwieldy. A major drawback of such systems is that in order to obtain the necessary travel of the gripping means to enable the accomplishment of the required exercises, the extent of vertical travel of the weights, and accordingly the vertical height of the unit, becomes too great to permit the device to be installed in homes and offices having ceilings of standard height. This drawback is successfully overcome by the apparatus of the present invention due to the novel design and arrangement of the pulley system of the unit.

A very successful device specifically designed to overcome the drawbacks of exercising with standard type barbells is described in U.S. Pat. No. Re. 28,066 issued to Walter Marcyan. Another highly successful device of this general class is described in U.S. Pat. No. 3,971,555 issued to Parker Mahnke. The present invention comprises an improvement upon this latter mentioned device.

As will be better understood from the description which follows, the present invention provides for the first time in a single unit, a compact, safe and highly efficient apparatus for accomplishing barbell lifting type exercises as well as pull type exercises.

SUMMARY OF THE INVENTION

It is an object of the present invention to provide an improved highly compact, easily useable and completely safe apparatus suitable for home and office use which is extremely versatile and is capable of being used for a wide variety of lifting type exercises as well as pull type muscle toning exercises.

More particularly it is an object of the invention to provide an exercising apparatus of the aforementioned character in which the major muscle groups of the body can be exercised by lifting type exercises wherein the trainee exerts vertical straight line forces on a vertically adjustable first body engaging means directly coupled with a weight stack and in which muscle toning exercises can be accomplished by the trainee exerting forces on a second vertically adjustable body engaging means connected to the same weight stack through a novel pulley arrangement.

It is another object of the invention to provide an apparatus of the class described in which the overall height of the machine is limited so that the device can conveniently be used in homes, offices and apartments, while at the same time providing the degree of travel of the second body engaging means necessary for the performance of all standard pull type exercises.

It is still another object of the invention to provide a machine as described in the preceeding paragraphs in which the increments of weight used for each exercise can readily be selected. More particularly it is an object of the invention to provide an apparatus wherein the increments of weight selected for the pull type exercises are equal to approximately one-half the increments of weight selectable for lift type exercises. In this way, numerous pull type muscle toning exercises best performed using small resistances can conveniently be accomplished without altering the weights or the weight selection means.

It is still another object of the present invention to provide an apparatus as heretofore described in which the second body engaging means may be disposed at any desired starting elevation without altering the elevation or path of travel of the weights.

Finally it is an object of the present invention to provide an exercising apparatus of the class described which will be easy and inexpensive to manufacture and install, which is simple to operate, adjust, maintain and repair and which is rugged and reliable in use.

In summary these and other objects of the invention are realized by a body exercising machine comprising an upright supporting structure, including spaced apart vertical tracks; a carriage adapted for movement along the tracks; first body engaging means for accomplishing lifting type exercises projecting laterally outwardly from the carriage for moving the carriage upwardly along the tracks; upper and lower wheel or bearing assemblies mounted on each side of the carriage; resistance means supported in the upright supporting structure; connecting means connecting the carriage and the weights whereby the carriage is biased in a vertically downward direction; second vertically adjustable body engaging means for accomplishing pull type exercises comprising: generally vertically extending guide means disposed proximate the upright structure; a vertically adjustable pulley pivotally carried by the guide means; pulley means disposed intermediate the guide means and the upright supporting structure; and a cable having a first end engagable by the trainee and the second end fixedly secured relative to the upright structure, the cable passing around the vertically adjustable pulley, around the pulley means and being operably associated with the carriage.

DESCRIPTION OF THE PREFERRED EMBODIMENT

Figure 1:
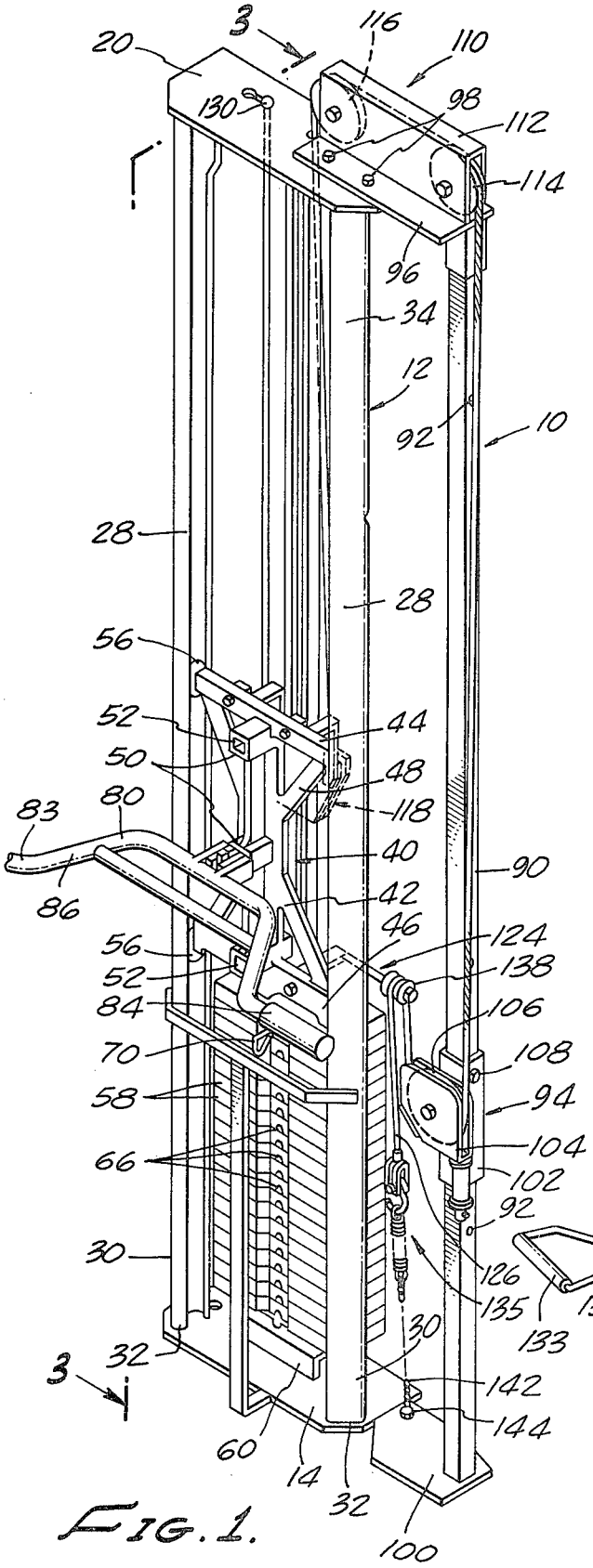
FIG. 1 is a perspective view of the apparatus of the present invention illustrating the configuration of the apparatus when used for lifting type exercises.

Referring to the drawings and particularly to FIG. 1, the present improved exercising apparatus, generally designated by the numeral 10, comprises an upright supporting structure 12, which includes a lower plate 14, adapted to be attached to a floor or other support and an upper plate 20 including a back edge 22 (FIG. 3) adapted for attachment to a wall or other support.

Also forming a part of upright supporting structure 12 is a pair of upright guide or track means 28, each having a lower portion 30 including an end 32 adapted to be attached as by welding to lower plate 14 at the location shown in FIG. 1. Members 28 also have upper portion 34 and an end 26 (FIG. 3) which is attached as by welding to upper plate 20 at the locations shown.

Figure 2:
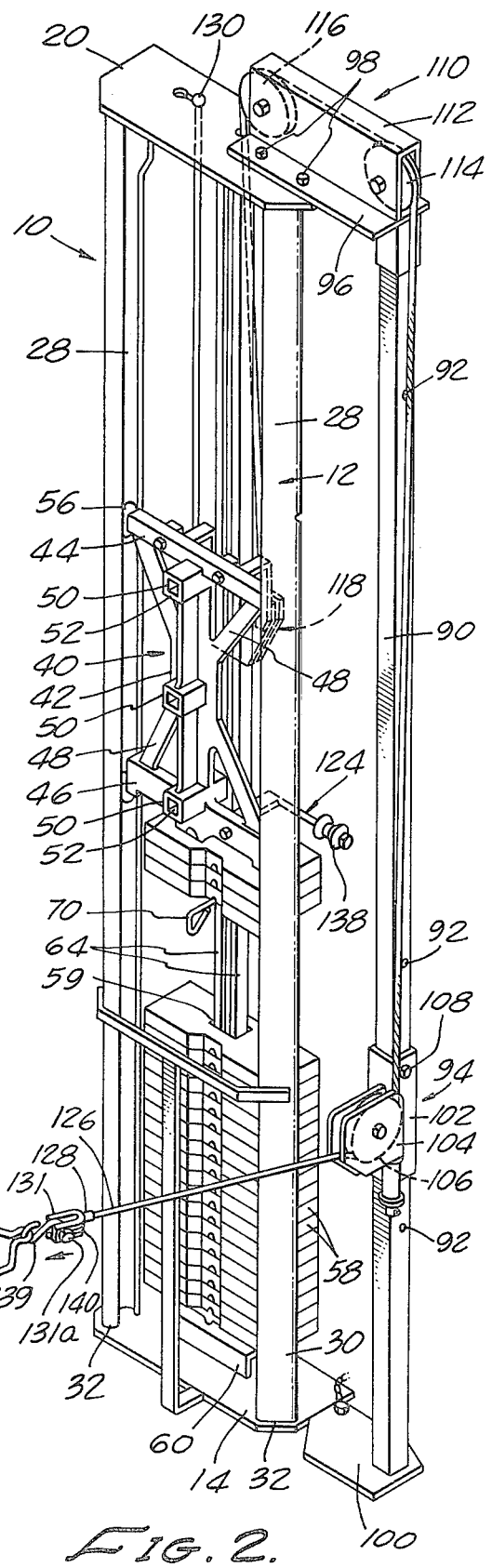
FIG. 2 is a perspective view similar to FIG. 1, but showing the appearance of the apparatus when used for accomplishing pull type exercises.
Figure 3:
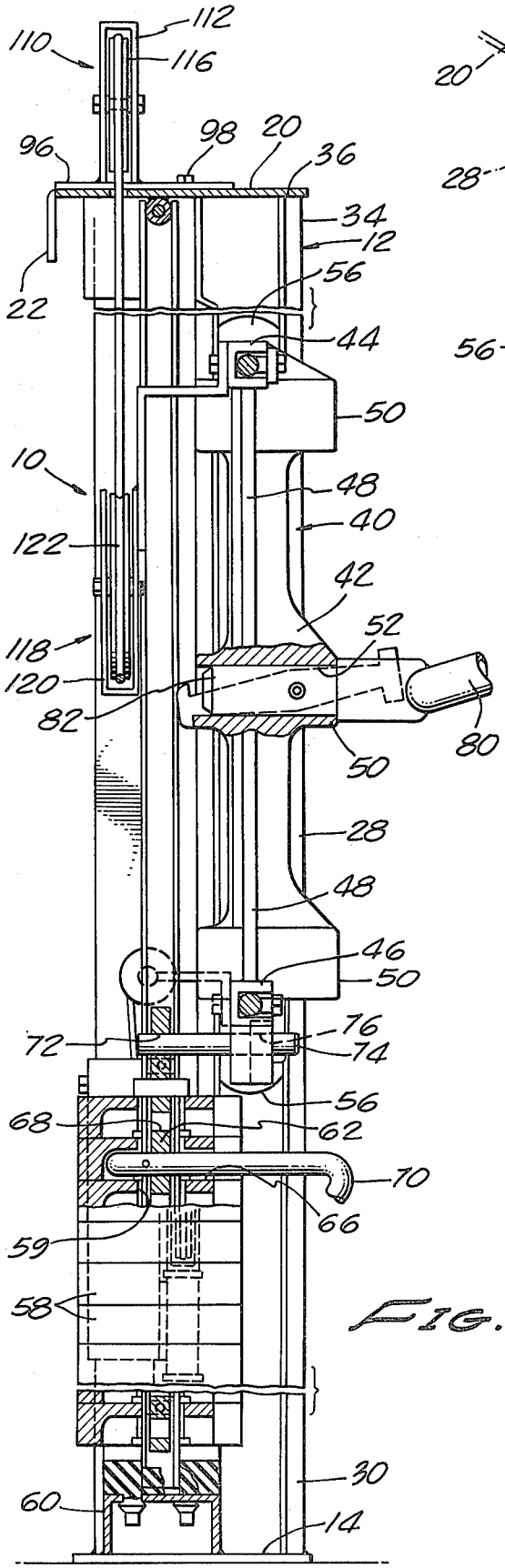
FIG. 3 is a cross-sectional view of the apparatus taken along lines 3—3 of FIG. 1.

Referring also to FIG. 3, machine 10 can be seen to include a vertically reciprocative carriage which is generally designated 40. As best seen in FIGS. 2 and 3, carriage 40 includes a superstructure 42 made up of spaced apart upper and lower transverse members 44 and 46 and cross-members 48. Affixed to the forward face of superstructure 42 are vertically spaced apart sockets 50 projecting forwardly of the carriage with each having a central bore 52 extending therethrough. The purpose of sockets 50 will be discussed in detail hereinafter.

Mounted for rotation at each end of transverse members 44 and 46 are wheels 56 which are adapted to mate with and roll smoothly along tracks 28 are carriage 40 is moved vertically.

Machine 10 also includes an adjustable resistance means comprising a series of weights 58 stacked on top of one another, the bottom one resting on a base pad 60 carried by bottom plate 14. Each weight is provided with a vertical aperture 59 (FIG. 2) extending therethrough for the accomodation of a vertically disposed selector bar 62 (FIG. 3) and its guide rods 64 (FIG. 2), the purpose of which will presently be discussed. Each weight also has an aperture 66 at right angles to the first mentioned aperture and in horizontal alignment with apertures 68 (FIG. 3) provided in selector bar 62. Thus each one of the apertures 66 is aligned with an aperture 68 and a pin 70 can be inserted therethrough so that only the weights above the pin, including the one containing the pin, will be interconnected with the selector bar.

As best seen in FIG. 3 selector bar 62 functions to interconnect the carriage 40 and the resistance means and is provided with an aperture 72 proximate its upper end for receiving a pin 74. Pin 74, in turn, is receivable in an aperture 76 provided proximate the lower edge of superstructure 42 of carriage 40. Thus, when pin 74 is in place within aperture 72 of the selector bar and aperture 76 of the carriage superstructure, the carriage and selector bar are operably interconnected.

The first body-engaging means or lifting arm of the device is designated by the numeral 80. The lifting arm comprises the socket-engaging portion 82 (FIG. 3) and the body-engaging portions 83. The socket-engaging portion is adapted to be telescopically receivable into the bore 52 of a selected socket 50 of the carriage 40. The body-engaging portions consist of horizontal coaxial handles 84 and shoulder-engaging portions 86 (FIG. 1). The lifting arm 80 coacts with the plurality of sockets 50 to provide a plurality of starting heights to, in turn, permit accomplishment of a plurality of barbell or lift type exercises. For example, if a man of medium height desired to perform a supine press, he would insert the free end of the lifting arm in the lowest socket with the handles downward. Likewise, if a man of medium height desired to perform a sitting press, he would insert the free end of the lifting arm in center socket with the handles upward. Similarly, if a man of medium height desired to perform an upright row, he would insert the free end of the lifting arm in the center socket with the handles downward. Likewise, if a man of medium height desired to perform a standing press, he would insert the free end of the lifting arm in the uppermost socket with the handles upward.

Other lift type exercises which can be performed using the first body engaging means for exercising principally the major muscle groups of the body include pull-ups, behind the neck presses, arm curls, tricep extensions, toe raises, deep knee bends, side bends and leg raises.

In operation of the apparatus for lift type exercises, with the apparatus configured as shown in FIG. 1, the trainee first decides how much weight he desires to lift and sets pin 70 into a selected aperture 66 in the series of adjustable weights 58. Apertures 66 have already been aligned with apertures 68 of the selector bar so that pin 70 forms a joinder between the weights of the series and the selector bar when such a selection is made.

As previously mentioned, since the selector bar is interconnected to carriage 40 by means of pin 74, when the adjustable resistance means is connected to the selector bar, the carriage will be downwardly biased. Next, depending upon the exercise to be performed, the trainee inserts the free end of the lifting arm into one of the vertically spaced sockets 50 of the carriage.

When the apparatus of the invention is to be used for performing pull type exercises, the pull type body exercising means of the invention is brought into play. This pull type body exercising means comprises vertical guide means disposed proximate the vertical tracks 28 and extending generally parallel thereto. In the embodiment of the invention shown in the drawings, this guide means is provided in the form of a generally rectangular, vertically extending guide member 90 having a plurality of vertically spaced apart apertures 92. Guide member 90 is adapted to slidably carry a vertically adjustable first pulley means identified in the drawings by the numeral 94. Proximate the upper end of member 90, there is provided an attachment means for releasably interconnecting member 90 with upright structure 12. In the present form of the invention the attachment means comprises a horizontally extending member 96 adapted to be releasably interconnected to top plate 20 as by fasteners 98. The lower end of member 90 is suitably fixed, as by welding, to a base plate 100 adapted to rest upon the floor. Base plate 100 may be affixed in any suitable manner to bottom plate 14 of upright structure 12 so that it is positioned coplanar therewith.

Referring to FIG. 2, first pulley means 94, in this form of the invention, comprises a body portion 102 within which member 90 is telescopically received. Pivotally connected to body portion 102, is a bracket 104 adapted to rotatably support a first pulley 106. Body portion 102 is apertured proximate its upper end to closely receive a locking pin 108, adapted to be removably received in apertures 92 for locating body portion 102 at various vertical heights along member 90.

Disposed intermediate member 90 and upright supporting structure 12 are second pulley means generally designated by the numeral 110. In this embodyment of the invention, second pulley means 110 comprises a bracket 112 which is carried by member 96 and is adapted to rotatably support second and third pulleys 114 and 116 respectively.

Figure 4:
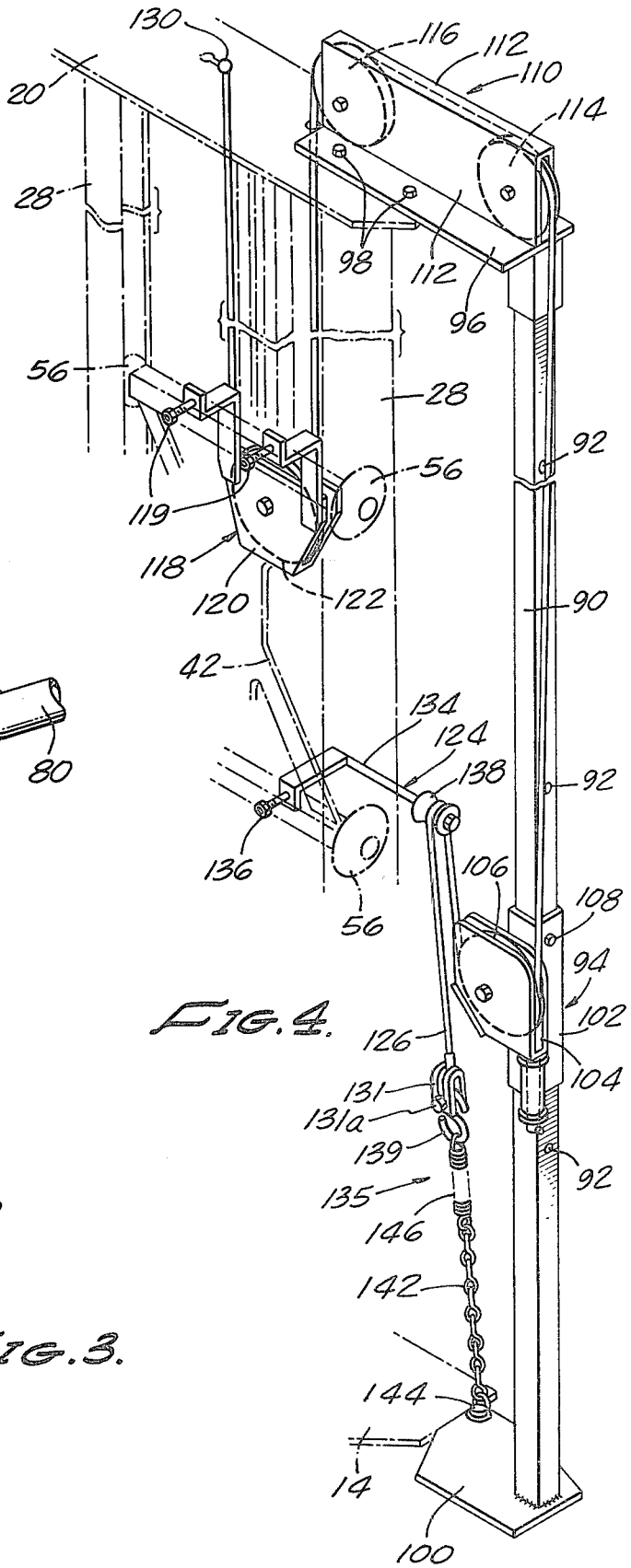
FIG. 4 is a generally schematic perspective view of the apparatus as shown in FIG. 1 but with portions broken away to illustrate the details of the construction of the pulley system of the apparatus.

As best seen by referring to FIG. 4, a third pulley means 118 is affixed to the rear face of carriage 40. Third pulley means 118 comprises a bracket 120 affixed to the back of carriage 40 by suitable fasteners 119, which bracket is adapted to rotatably support a fourth pulley 112.

Provided at the first or free end 128 of cable 126 is a yoke member 131 adapted to removably receive over a cross pin 131*a* a hook shaped member 132 connected to a handle means 133. Handle means 133 is adapted to be gripped by the trainee during the performance of pull type exercises.

In operation of the apparatus for pull type exercises, the trainee first decides how much weight he desires to lift, and, in the manner previously described, inserts pin 70 into a selected aperture 66 in the weights 58 (FIG. 3). Next the trainee slides body portion 102 upwardly or downwardly over member 90 to the desired vertical starting height and inserts locking pin 108 into an appropriate aperture 92. The trainee then grips handle means 133 either with his hands or feet and pulls outwardly and upwardly or downwardly relative to the face of the apparatus. Because of the interconnection of the cable 126 with the carriage 40 this outward pulling force causes the carriage along with the number of weights which have been selected to be raised upwardly along track members 28.

An important feature of the present invention resides in the fact that due to the unique pulley arrangement as shown in the drawings, the amount of weight being lifted by the trainee through a pulling action on handle 133 is approximately one half the amount of weight which would be lifted by the trainee were he to exert a lifting force on the first body engaging means or handle 80. Stated another way, if each weight in the weight stack is ten pounds and one weight is selected to be raised, the lifting force exerted by the trainee on the first body engaging means will of course be ten pounds, plus the weight of the carriage. With the apparatus configured as shown in FIG. 2, however, the pulling force exerted by the trainee outwardly on handle 133 will result in the trainee lifting an effective weight of only 5 pounds, plus one half the weight of the carriage. This unique antomatic weight reduction feature of the apparatus permits increases in the effective resistance in smaller increments thereby allowing numerous muscle toning exercises to be performed which would otherwise be impossible. This novel configuration also permits a greater degree of travel of the cable without increasing the overall weight of the apparatus.

By the way of example, the types of muscle toning exercises which can be performed on the apparatus of the invention when the apparatus is configured as shown in FIG. 2, include the following: lateral shoulder raises, straight arm pull-overs, seated rowing, arm curls, tricep extensions, leg curls, leg pull-overs, thigh pulls, and neck contractions.

Another unique and important feature of the apparatus of the present invention resides in the novel take-up means of the apparatus for operably interconnecting the cable in a closed loop with the resistance means when the trainee is performing exercises using the first body engaging means. In the present embodiment of the invention, this take up means comprises the earlier mentioned idler means 124 as well as a securement means for fixedly securing the free end of cable 126, relative to the upright structure. Thus, with interconnection shown in FIG. 1 and 4, as carriage 40 is raised by the trainee through exertion of lifting forces on the first body engaging means 80, the cable will travel in a fixed endless path.

Referring particularly to FIG. 4 of the drawings, idler pulley means 124 can be seen to comprise an "L" shaped bracket 134 one end of which is affixed by an appropriate fastener, 136 to the front face of carriage 40. Rotatably carried at the other end of bracket 134 is an idler pulley, or roller, 138.

When the apparatus of the invention is to be converted from one for the performance of pull type exercises into one for the performance of lifting exercises, handle means 133 is first removed from a yoke member 131. Yoke member 131 is then interconnected with an "S" shaped hook member 139 of earlier mentioned securement means 135. As best seen in FIG. 4 securement means 135 in the present form of the invention comprises a length of chain or cable 142 one end of which is affixed to a fastener 144, removably connected with bottom plate 100. Connected to the opposite end of chain 142 is a biasing means or spring 146 which is in turn connected with the "S" shaped bracket 139. Spring 146 functions to continuously maintain tension on cable 126 when the cable is interconnected with the securement means in the manner shown in FIG. 4. The spring also functions to compensate for any streching of the cable due to continued use of the apparatus and maintains the cable taut. With this unique arrangement, as the carriage is lifted by the trainee exerting upward forces on the first body engaging machine, cable 126 will pass under pulley 122, over pully 116 and 114, and under pulley 106 and over idler pulley 138. When it is desired to use the apparatus for pull type exercises, yoke 131 is simply disconnected from the securement means and handle 133 is connected thereto.

It is to be appreciated that the second body engaging means, which permits pull type exercises to be performed, can be sold as an integral part of the complete apparatus, or in the alternative can be sold as a separate unit for interconnection with a basic lift type exercise unit of the construction shown in the drawings.

Having how described the invention in detail in accordance with the requirements of the patent statutes, those skilled in this art will have no difficulty in making changes and modifications in the individual parts on their relative assembly in order to meet specific requirements or conditions. Such changes and modifications may be made without departing from the scope and spirit of the invention, as set forth in the following claims.

We claim:

1. In an exercising machine of the type having an upright supporting structure, upright guide means associated with said upright supporting structure, a carriage which slides vertically upward and downwardly on said upright guide means, first body-engaging means connected to said carriage for engagement by a trainee, and adjustable resistance means associated with the carriage to bias the carriage and first body-engaging means in a vertically downward direction, the improvement which consists of a pull type body exercising means for performance of various exercises by the trainee comprising:

(a) guide means, disposed proximate said upright guide means and extending generally parallel thereto;

(b) a vertically adjustable first pulley means including a first pulley carried by said guide means;

(c) second pulley means disposed intermediate said vertical tracks and said guide means;

(d) third pulley means, including a fourth pulley, carried by said carriage;

(e) a cable having a first free end and a second end connected to said supporting structure, said cable being reeved around said first, second and fourth pulleys;

(f) second body engaging means connected to said first end of said cable; and (g) securement means for fixedly securing said free end portion of said cable relative to said upright structure when the trainee is engaging said first body-engaging means whereby as said carriage and weights are raised by the trainee exerting force upon said first body engaging means, said cable will be disposed in a closed loop configuration.

2. An exercising means as defined in claim 1 including attachment means for releasably interconnecting said pull type exercising means with said upright supporting structure.

3. A body exercising machine for use by a trainee in accomplishing both lifting and pull type exercises comprising:

(a) an upright supporting structure, including a top member and spaced apart substantially vertical track means;

(b) a carriage adapted for movement along said track means;

(c) first body engaging means for accomplishing lifting type exercises projecting laterally outwardly from said carriage, for moving said carriage upwardly along said track means in response to vertical straight line forces exerted by the trainee;

(d) upper and lower bearing means mounted on each side of said carriage, said bearing means engaging and moving along said track means;

(e) resistance means supported in said upright supporting structure;

(f) connecting means connecting said carriage and said resistance means whereby said carriage is biased in a vertically downward direction, and whereby movement of said carriage is an upward direction will raise said resistance means;

(g) pull type body exercising means for accomplishing pull type exercises comprising:

(1) generally vertically, extending guide means disposed proximate said upright structure;

(2) vertically adjustable pulley means carried by said guide means including a first pulley;

(3) second pulley means disposed intermediate said guide means and said upright supporting structure;

(4) a cable having a first end portion engageable by the trainee and a second end fixedly secured relative to said upright structure, said cable passing around said vertically adjustable pulley, around said pulley means, and being operably associated with said carriage; and (5) securement means for fixedly securing said free end portion of said cable relative to said upright structure when the trainee is engaging said first body-engaging means whereby as said carriage and weights are raised by the trainee exerting force upon said first body-engaging means, said cable will travel over said second pulley means, and under said first pulley.

4. A body exercising machine as defined in claim 3 including attachment means for releasably interconnecting said second body engaging means and said upright structure.

5. A body exercising machine as defined in claim 4 in which said second pulley means comprises at least one pulley rotatably carried by said attachment means and further includes a pulley rotatably mounted on said carriage said cable being reeved under said first pulley, over said pulley carried by said attachment means and under said pulley mounted on said carriage.

6. A body exercising machine as defined in claim 4 in which said second pulley means comprises a pair of horizontally spaced apart pulleys rotatably carried by said attachment means.

7. A body exercising machine for use by a trainee in accomplishing both lifting and pull type exercises comprising:

(a) an upright supporting structure, including a top member, a bottom member and spaced apart substantially vertical tracks;

(b) a carriage adapted for movement along said tracks;

(c) first body engaging means for accomplishing lifting type exercises projecting laterally outwardly from said carriage, for moving said carriage upwardly along said track means in response to vertical straight line forces exerted by the trainee;

(d) upper and lower bearing means mounted on each side of said carriage, said bearing means engaging and moving along said track means;

(e) a plurality of weights supported in said upright supporting structure;

(f) connecting means connecting said carriage and at least one of said weights whereby said carriage is biased in a vertically downward direction, and whereby movement of said carriage in an upward direction will raise said weights;

(g) pull type body exercising means for accomplishing pull type exercises comprising:

(1) a generally vertically extending guide member disposed proximate said upright structure;

(2) vertically adjustable first pulley means carried by said guide means including a first pulley;

(3) attachment means for releasably interconnecting said pull type exercising means with said upright supporting structure;

(4) a pair of horizontally spaced apart second and third pulleys rotatably carried by said attachment means;

(5) a fourth pulley rotatably carried by said carriage;

(6) a cable having a first end portion engageable by the trainee and a second end fixedly secured relative to said upright structure, said cable passing under said first pulley, over said second and third pulleys and under said fourth pulley;

(7) idler pulley means carried by said carriage and including an idler pulley adapted to be operably associated with said cable; and (8) securement means for fixedly securing said free end portion of said cable relative to said upright structure when said cable is associated with said idler pulley whereby as said carriage and weights are raised by the trainee exerting force upon said first body engaging means, said cable will travel under said fourth pulley over said second and third pulleys, under said first pulley and over said idler pulley.

8. A body exercising machine for use by a trainee in accomplishing both lifting and pull type exercises comprising:

(a) an upright supporting structure, including substantially vertical guide means;

(b) a carriage adapted for movement along said guide means;

(c) first body engaging means for accomplishing lifting type exercises projecting laterally outwardly from said carriage, for moving said carriage upwardly along said guide means in response to forces exerted by the trainee;

(d) bearing means mounted on said carriage for engaging and moving along said guide means;

(e) resistance means associated with said carriage for biasing said carriage in a downward direction;

(f) pull type body exercising means for accomplishing pull type exercises comprising:

(1) a generally vertically extending guide member disposed proximate said upright supporting structure;

(2) first pulley means carried by said guide means;

(3) attachment means for releasably interconnecting said pull type exercising means with said upright supporting structure;

(4) second pulley means carried by said attachment means;

(5) third pulley means carried by said carriage;

(6) a cable having a first end portion engageable by the trainee and a second end fixedly secured relative to said upright structure, said cable passing under said first pulley means, over said second pulley means and under said third pulley means; and (7) securement means for fixedly securing said free end portion of said cable relative to said upright structure when the trainee is engaging said first body engaging means, whereby as said carriage is raised by the trainee exerting force upon said first body engaging means, said cable will be disposed in a closed loop configuration.

9. A body exercising machine as defined in claim 8 including idler pulley means carried by said carriage and including an idler pulley adapted to be operably associated with said cable when said free end of said cable is secured relative to said upright structure.

* * * * *